US005220732A

United States Patent [19]

Lee

[11] Patent Number: 5,220,732

[45] Date of Patent: Jun. 22, 1993

[54] COOLING ROCKS AND SAND

[76] Inventor: Michael Lee, 2311 Kent La., Colorado Springs, Colo. 80909

[21] Appl. No.: 832,975

[22] Filed: Feb. 10, 1992

[51] Int. Cl.[5] ..... F26B 7/00

[52] U.S. Cl. ..... 34/13; 34/62; 34/20; 34/131

[58] Field of Search ..... 34/130, 131, 134, 137, 34/20, 12, 13, 62, 63

[56] References Cited

U.S. PATENT DOCUMENTS

| | | | |
|---|---|---|---|
| 832,961 | 10/1906 | Elkus | 34/136 |
| 1,496,651 | 6/1924 | Bentz | 34/20 |
| 1,545,055 | 7/1925 | Lindhard | 34/20 |
| 2,160,956 | 6/1939 | Cheesman | 34/20 |
| 2,305,078 | 12/1942 | Harford | 34/20 |
| 2,363,037 | 11/1944 | Arnold | 34/20 |
| 2,363,282 | 11/1944 | Arnold | 34/20 |
| 3,161,485 | 12/1964 | Buhrer | 34/236 |
| 3,358,380 | 12/1967 | Murphy | 34/20 |
| 3,469,324 | 9/1969 | Vissers | 34/136 |
| 4,037,330 | 7/1977 | Kemmetmuller | 34/20 |
| 4,177,575 | 12/1979 | Brooks | 34/20 |
| 4,304,286 | 12/1981 | Waldron | 164/4.1 |
| 4,441,261 | 4/1984 | Beckmann | 34/20 |

OTHER PUBLICATIONS

Lee, "Economical Cooling of Hot Weather Concrete," *Concrete Construction*, Sep. 1989.

Nomura et al., "Continuous Cooling of Wet Foundry Sand Using a Fluidized Bed," *Particulate Science and Technology* 5:207-218, 1987.

Goto et al., "Precooling Concrete Using Frozen Sand," *Concrete International*, 60-65, Jun. 1990.

Riquelme and Navarro, "Analysis and Modeling of Rotatory Dryer—Drying of Copper Concentrate," *Drying Solids*, pp. 46-53, (John Wiley 1986).

Hirouse, "Influence of Particles Falling from Flights on Volumetric Heat Transfer Coefficient in Rotary Dryers and Coolers," *Powder Technology*, 59 (1989) 125-28.

*Primary Examiner*—Henry A. Bennett
*Assistant Examiner*—Denise L. F. Gromada
*Attorney, Agent, or Firm*—Linda F. Gould

[57] ABSTRACT

A process of cooling sand and rocks enables large amounts of aggregate to be cooled to a desired temperature below ambient aggregate temperature. Such temperature reduction is particularly useful for preparing concrete. Aggregate is introduced into a rotating cylinder, in which the aggregate is slowly mixed and moved. Chilled gas is also introduced into the cylinder, to contact the aggregate particles and reduce the temperature of the aggregate. Chilled gas may be provided by blowing ambient air or gas into contact with a chilled gas or liquid supply, and then directing the chilled gas into the cylinder. The gas may be recirculated in a closed system, to conserve energy and prevent aggregate fines from being lost.

17 Claims, 2 Drawing Sheets

COOLING ROCKS AND SAND

1.0 BACKGROUND OF THE INVENTION 1.1 Technical Field

This invention pertains to concrete production, and in particular a method of cooling fine and coarse aggregates to lower the temperature of concrete.

1.2 Background Art

The production of concrete is typically accomplished by mixing cement, water, rock (coarse aggregate) and sand (fine aggregate). The particular ratio of water and cement is chosen to establish the strength and other properties desired for the specific use of each batch of concrete.

Weather conditions may indirectly affect the ultimate water-cement ratio, changing that ratio from pre-determined specifications. For example, if concrete is being mixed and poured in hot temperatures, more water may be required to hold slump constant. If the amount of water added at the job site significantly increases the water-cement ratio, the hardened concrete may have less strength, and be otherwise adversely affected.

Hot weather will increase the temperature of concrete components, resulting in increases to the temperature of the mixed and placed concrete. Warmer concrete causes the cement to react faster with the water, which causes a higher peak setting temperature. These increases to the temperature of the setting concrete result in expansion of the concrete. Eventually, the concrete will contract as it cools to ambient temperatures. This expansion and contraction weakens the concrete and causes thermal cracking.

To avoid the detrimental effects of hot weather on concrete production, a number of methods have been used to cool the concrete during mixing. For example, bagged, block, or flake ice has been used to lower the temperature of a concrete mixture. However, when using bagged and block ice as a cooling medium, it is difficult to control the total mix water content, and thus the water-cement ratio. Flake ice is associated with an expensive on-site ice production facility with ice weighing equipment. This system solves the water cement ratio control problem but at considerable expense.

Liquid nitrogen has also been used to cool concrete during mixing. For example, by injecting liquid nitrogen into ready-mix trucks at a job site, the concrete mixture can be reduced to a desired temperature immediately prior to pouring. Although this method of cooling is effective, the large amounts of liquid nitrogen required are costly.

Chilling concrete batch water with a mechanical refrigeration plant may be used to cool the concrete mixture, while still allowing the water-cement ratio to be exactly determined. However, since aggregate constitutes a much larger portion of the concrete mixture than the water component, the concrete mixture can be more effectively cooled by lowering the aggregate temperature in addition to chilling the water.

Coarse aggregate cooling has been successfully used to cool concrete production. An article written by the Applicant, "Economical Cooling of Hot Weather Concrete", *Concrete Construction,* September 1989, describes a method of cooling rock. In that method, the rocks which form the coarse aggregate component of a concrete mix may be cooled by evaporating water on the coarse aggregate surface. This is accomplished by keeping the coarse aggregates wet for a time period prior to batching by sprinkling or spraying ambient water onto the coarse aggregates. Although this method has limited usefulness in humid climates, coarse aggregate evaporative cooling in dry climates serves to reduce the aggregate temperature. For more significant temperature reductions, cold water may be used to inundate the coarse aggregates prior to concrete mixing. Coarse aggregate temperatures can be reduced to within 10 degrees Farenheit of the chilled water temperature using this method.

The novel process of this invention involves cooling the sand or rock component of concrete mixtures using chilled or refrigerated air, or other chilled or liquified gas, in a rotary drum device. Some methods of sand cooling are known in other industries. For example, in U.S. Pat. No. 4,304,286 to Waldron, sand is cooled as a part of a process of making moulds. The cooling process is accomplished by suspending the sand in a fluidized bed to which a blower supplies fluidizing air at ambient temperature, and then introducing a cryogenic liquid to contact the sand in its fluidized state.

A fluidized bed method of cooling sand for molding operations is also discussed in Nomura et al, "Continuous Cooling of Wet Foundry Sand Using a Fluidized Bed", *Particulate Science and Technology* 5:207–218, 1987. This article describes a theoretical model for cooling sand by evaporation, using ambient temperature air as the coolant air and water in a fluidized bed.

An apparatus for cooling foundry sand is described in U.S. Pat. No. 3,358,380 to Murphy. This device comprises a rotatable disc onto which sand is placed. The disc has perforations through which ambient temperature air is blown, to aerate and cool the sand.

U.S. Pat. No. 3,161,485 to Buhrer also discusses cooling sand for a molding process. Sand and cooling water are mixed with rotatable paddles in a trough. The sand exits the trough on a vibrating support, with perforations through which ambient temperature air is blown. Thus, the sand is cooled by evaporation as it travels on the vibrating support.

The methods known for cooling sand used in molding are useful for their intended purpose. However, the greater quantities of sand or rock required to produce concrete for large structures cannot efficiently be cooled in a fluidized bed or on a perforated carrier. The capital equipment costs would be prohibitively expensive. Similarly, the perforated carriers of Buhrer and Murphy are not well suited to quickly cooling vast quantities of sand or rock.

A process of cooling fine aggregates prior to concrete mixing is described in Goto et al., "Precooling Concrete Using Frozen Sand", *Concrete International,* 60–65, June 1990. Liquid nitrogen is used to reduce the temperature of the sand to below the freezing point of water, while the sand is stirred with mixing blades. While significant quantities of sand may be cooled with this process, the use of liquid nitrogen is very expensive.

A less expensive apparatus for cooling sand has been explored through mathematical models and small scale prototypes discussed in Riquelme and Navarro, "Analysis and Modeling of Rotatory Dryer—Drying of Copper Concentrate", *Drying Solids,* pgs 46–53, (John Wiley 1986), and Hirosue, "Influence of Particles Falling from Flights on Volumetric Heat Transfer Coefficient in Rotary Dryers and Coolers," *Powder Technology,* 59 (1989) 125–28. These articles teach the heating or drying of fine particles within a rotating drum. Ambient temperature air introduced into the drum effectuates a temperature change in the sand within the drum, although cooling is not an objective of the described processes.

A process of cooling large quantities of aggregates is needed, to efficiently and economically cool concrete production.

2. DISCLOSURE OF THE INVENTION

2.1 Summary of the Invention

An object of this invention is to provide a method of cooling large quantities of aggregate, to be used as a component of concrete.

Another object of this invention is to provide an aggregate cooling method which is more economical and efficient than some processes presently used to cool concrete.

The aggregate cooling method of the present invention involves introducing sand or rocks into a large rotating cylinder. The cylinder has two open ends, so that aggregate may enter the cylinder through one end and may exit the cylinder at the opposite end, falling onto a transportation device or storage bin. In one embodiment, the cylinder will be rotating around an axis which forms an acute angle with the ground, so that gravity moves the aggregate through the cylinder, while the sides of the cylinder prohibit the aggregate from dropping out of the cylinder prior to reaching the lower end.

The cylinder may be constructed with flat plates, called flights, which are attached to the interior of the cylinder. Each flight catches some portion of the aggregate when the flight is at the bottom of the cylinder's rotation, causing that portion of the aggregate to be raised on the flight as the cylinder rotates, until the aggregate drops off the flight as rotation causes the flight to turn and drop the aggregate to the lowest portion of the cylinder. These flights may be curved to facilitate movement of aggregate through the cylinder, even when the cylinder is parallel to the ground.

While aggregate is mixed by the rotating cylinder, the aggregate is cooled by air or other gas blown through the cylinder. The gas may be forced by a motor driven blower to move through a heat exchanger which lowers the gas temperature. The chilling medium on the other side of the exchanger can be either chilled liquid or gas. Next, the gas is moved through the cylinder to contact the mixing aggregate. The exhaust gas may either be vented to the atmosphere or recycled in a closed loop back to the gas feed side of the cylinder. Such a closed loop system has the advantage of avoiding introducing additional water to the system as an external gas is blown into the cylinder.

The chilled gas or liquid supply may advantageously comprise a series of coils in which chilled gas or liquid is circulated. In this manner, the heat from gas contacting the coils is transferred to the liquid, and removed from the system. Newly chilled gas or liquid may be circulated into the coils as needed to maintain a particular temperature. A refrigeration device is used to cool or condense the warmed gas or liquid so that it will again be effective to reduce the temperature of warmed air. A compressor may be used to move condensed gas and a pump may be used to move a chilled liquid through the coils to supply re-chilled gas or liquid as often as needed.

The novel features that are considered characteristic of the invention are set forth with particularity in the claims. The invention itself, both as to its construction and its method of operation, together with additional objects and advantages thereof, will best be understood from the description of specific embodiments which follows, when read in conjunction with the accompanying drawings.

2.2. Brief Description of the Drawings

2.3 Detailed Description of the Preferred Embodiment

Figure 1:
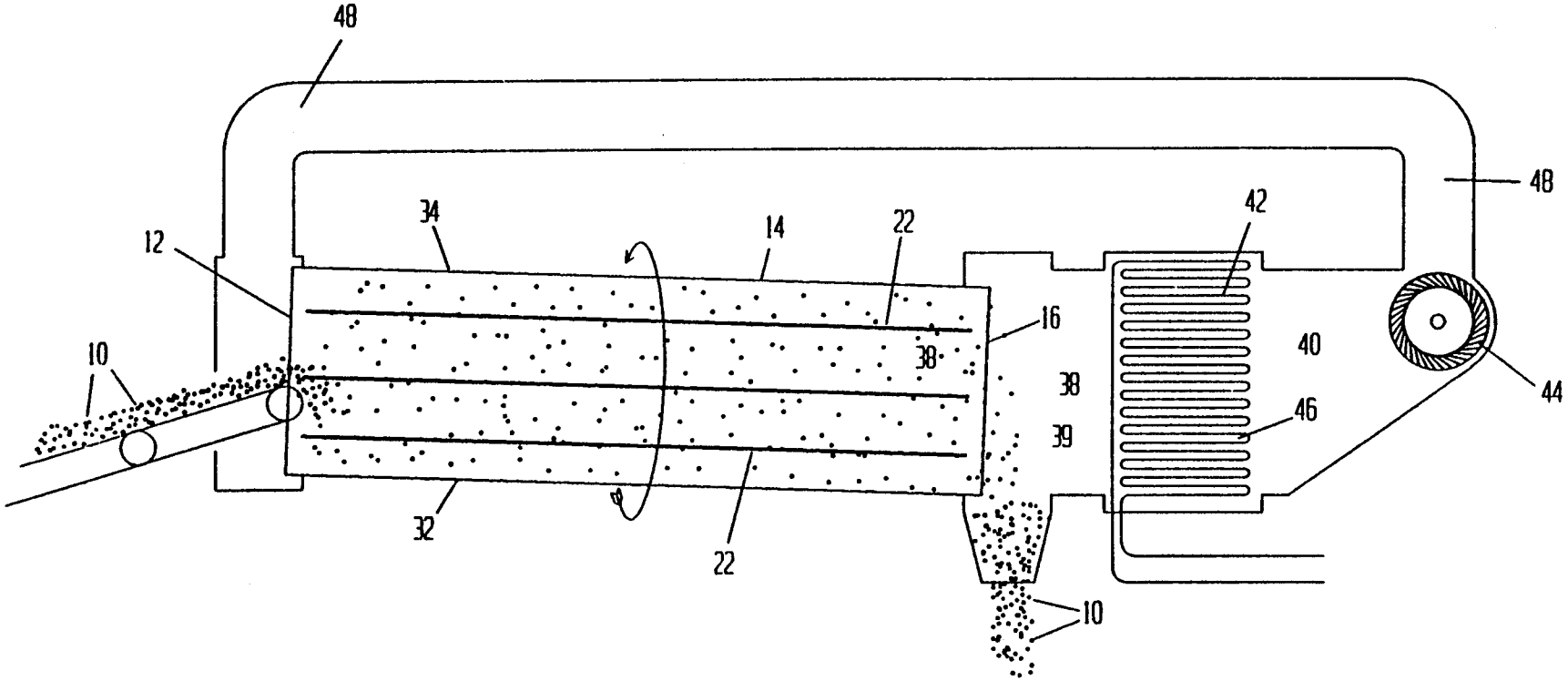
FIG. 1 is a cross-section view of an apparatus for cooling aggregate used in concrete production, using the method described herein.
Figure 2:
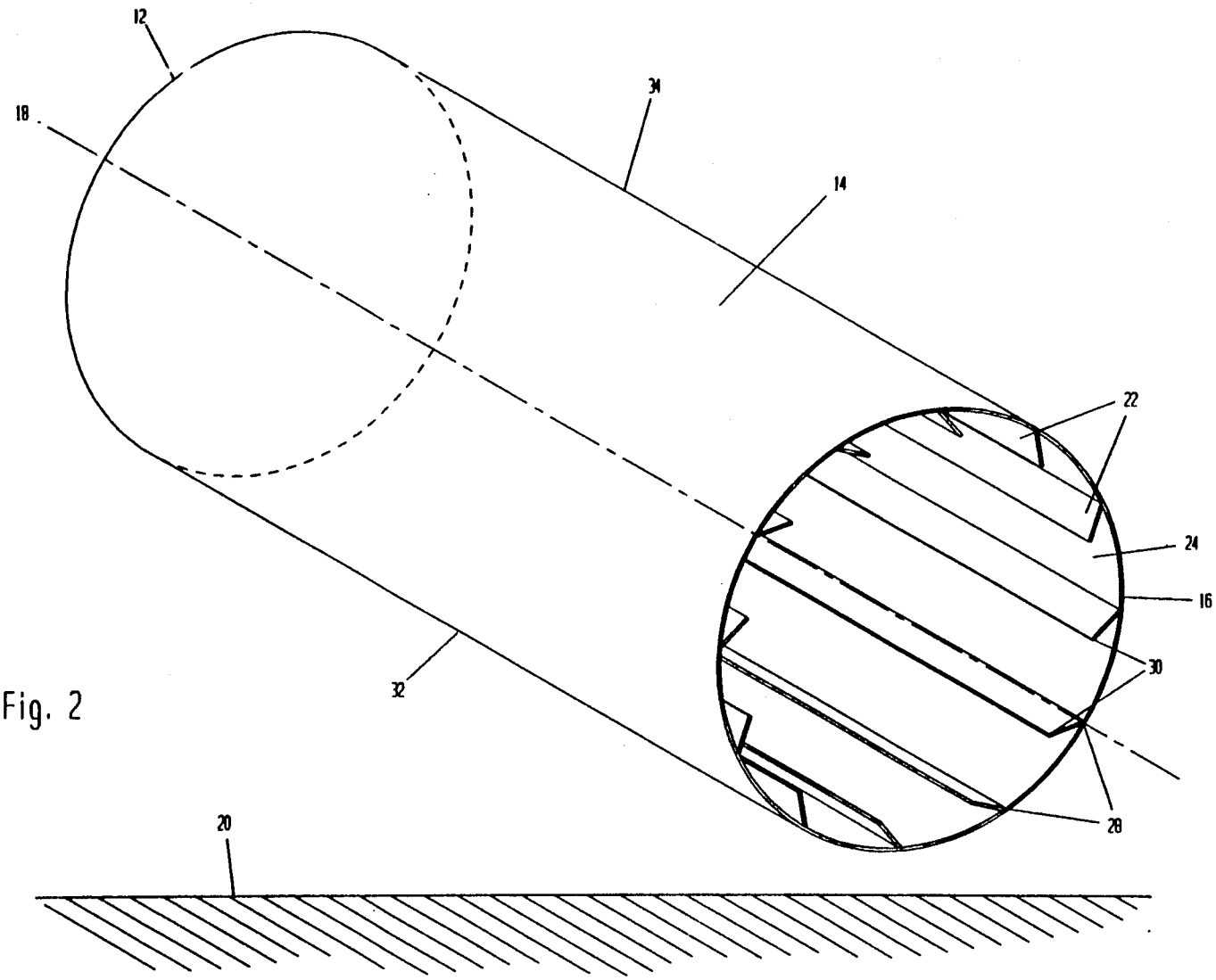
FIG. 2 is a perspective view of a rotating cylinder used in this method of cooling aggregate.

The features of the aggregate cooling technique according to the present invention can be better understood by reference to FIG. 1. As is shown in FIG. 1, aggregate 10 is directed into an open entrance end 12 of a cylinder 14. An open exit end 16 of the cylinder 14 is opposite the entrance end 12. The cylinder 14 has an axis 18 running along the center of the cylinder 14 from the entrance end 12 to the exit end 16. The cylinder 14 may be advantageously positioned as shown in FIG. 2, so that the entrance end 12 is higher with respect to the ground 20 than the exit end 16.

As aggregate 10 is introduced into the cylinder 14, the cylinder 14 is rotated by an electric motor (not shown). When the cylinder 14 is positioned so that the axis 18 forms an angle of 1 to 10 degrees with respect to the ground 20, aggregate will fall slowly through the cylinder 14 from the entrance end 12 to the exit end 16.

The cylinder 14 has an upper portion 34 which is generally above the axis 18, and a bottom 32 which is generally between the axis 18 and the ground 20. Flat plates called flights 22 may be advantageously arranged in the interior 24 of the cylinder 14, as is best shown in FIG. 2. Each flight 22 has a exterior side 28 attached to the interior 24 of the cylinder 14, and an interior side 30 which projects toward the axis 18 of the cylinder 14. Therefore, as the cylinder 14 rotates, each flight 22 will be carried from the bottom 32 of the cylinder 14 into the upper section 34 of the cylinder 14, and then back to the bottom 32.

During rotation, some aggregate 10 in the cylinder 14 may be caught on each flight 22, which will carry that aggregate 10 from the bottom 32 of the cylinder 14 to the upper section 34 of the cylinder 14, until the aggregate 10 drops off the flight 22 as rotation causes the flight 22 to tilt downward with the exterior side 28 closer to the bottom 32 of the cylinder 14 than the interior side 30 of that same flight 22. The flights 22 may be curved to facilitate movement of aggregate 10 through the cylinder 14, even when the cylinder 14 is parallel to the ground 20.

Movement of the aggregate 10 in this manner accomplishes two purposes First, the aggregate 10 is transported through the cylinder 14 at a controlled rate of speed, instead of falling directly to the exit end 16, or becoming clogged within the cylinder 14. Secondly, mixture of the falling aggregate 10 with chilled gas 38 facilitates cooling of the aggregate 10, by exposing more particles of aggregate 10 to the chilled gas 38.

Chilled gas 38 may be introduced into the cylinder 14 in a number of ways. The chilled gas 38 may comprise air or other gas, which has been cooled by contact with a chilled gas or liquid supply 42. In a preferred embodiment of this innovative process, ambient air 40 is forced into contact with a chilled gas or liquid supply 42 by blowing the air 40 with a blower mechanism 44 such as a motor driven fan. The blower 44 is advantageously situated to push and direct the air 40 in the direction of the chilled gas or liquid supply 42, causing the air 40 to contact the chilled gas or liquid supply 42, then pushing the now chilled air 39 in the direction of one of the open ends 12,16 of the cylinder 14. A most efficient cooling process results from directing the chilled air 39 into the cylinder 14 through the exit end 16 through which the aggregate 10 exits the cylinder 14. This produces a counter current of chilled air 39 running opposite the direction in which the aggregate 10 is flowing, increasing the overall system cooling efficiency. In this manner, colder chilled aggregate temperatures are made possible with a given chilled gas temperature.

The chilled gas 38 may also comprise a cryogen such as liquid nitrogen or liquid carbon dioxide, which is sprayed directly into the cylinder 14. Beneficially, no chilling mechanism such as a blower 44 and chilled gas or liquid supply 42 is required with a cryogen is used as the chilled gas 38. Use of a cryogen may be particularly useful for reducing the temperature of a large quantity of aggregate 10 for a short period of time.

A number of different gases or liquids 46 may be advantageously used in the chilled gas or liquid supply 42. The choice of gas or liquid 46 will to some extent depend on the particular temperature to be achieved for the aggregate 10. For example, if it is determined that chilled air 39 at a temperature of thirty-three degrees Fahrenheit is desirable for cooling the aggregate 10, then a 15% solution of glycol and water at twenty-five to thirty-one degrees Fahrenheit may be conveniently used to properly cool ambient air 40 while avoiding a need to defrost the chilled gas or liquid supply 42.

In cases where a relatively small temperature drop is desired, such as cooling aggregate 10 from ninety degrees Farenheit to seventy degrees Farenheit, chilled water may be economically used as the chilled liquid supply 42. Packaged water chillers may be used in such situations.

In some cases freon, ammonia, or other refrigerant will be used as the chilled gas or liquid supply 42. Such refrigerants may be placed directly into a coil or tube (not shown) which is then placed into the path of the ambient air 40 or other gas. This process will achieve extreme decreases in temperature of the aggregate 10, and may actually be used to freeze the aggregate 10.

In determining the desired temperature for the chilled gas 38, it is advantageous to consider the wet bulb temperature of the chilled gas 38, rather than its temperature as standardly measured. To measure wet bulb temperature, wet guaze may be conveniently wrapped around the bulb of a thermometer, while the thermometer is used to measure the temperature of the chilled gas 38. In this manner, both the temperature and humidity of the chilled gas 38 are taken into account. In general, the wet bulb temperature of the chilled gas 38 should be equal to or lower than the desired temperature which is to be achieved for the aggregate 10.

The chilled gas 38 is forced by the blower 44 to enter the cylinder 14, and travel through the cylinder 14 where particles of aggregate 10 are contacted by the chilled gas 38, resulting in a reduction in temperature of the aggregate 10. Thus, by the time the aggregate 10 reaches the exit end 16 of the cylinder 14, the temperature of the aggregate 10 may be significantly reduced to meet specifications for concrete production or for other uses. As the cooled aggregate 10 exits the cylinder 14, it may be funneled into a storage bin or transportation device (not shown).

Concrete production is sensitive to changes in the ratio of water and cement present in the concrete mixture. Thus, use of a closed system for cooling the aggregate 10 may be particularly advantageous, since such a closed system would enable the cooling process to be accomplished without introducing more water to, or removing water from, the aggregate 10.

The chilled gas 38 can be conserved by using a closed system where the exiting gas 38 is brought back into the system to be re-cooled. This process also enables recycling and control of fine aggregate particles, or "fines", which might otherwise exit the system. A closed system may be constructed by enclosing the chilled gas or liquid supply 42, and both ends 12,16 of the cylinder 14, in air ducting 48, as shown in FIG. 1. In this manner, gas warmed by contact with the aggregate 10 exits the entrance end 12 of the cylinder 14, and is routed through the air ducting 48 back to the location of the chilled gas or liquid supply 42. One or more blower mechanisms 44 may be used to facilitate directing the air through the air ducting 48.

The invention has been described in detail with particular reference to preferred embodiments thereof. As will be apparent to those skilled in the art in the light of the accompanying disclosure, many alterations, substitutions, modifications, and variations are possible in the practice of the invention without departing from the spirit and scope of the invention. The invention may prove useful in a number of situations, and is particularly advantageous in the art of concrete production.

I claim:

1. A method for cooling rocks or sand used in concrete production to a desired aggregate temperature, comprising the steps of:

introducing the rocks or sand into a cylinder with an entrance end and an exit end, by placing the rocks or sand into said entrance end, prior to combining the rocks or sand with other concrete components to produce concrete, rotating said cylinder, and introducing chilled gas with a temperature lower than ambient air temperature into said cylinder.

2. A method for cooling rocks or sand as described in claim 1, further comprising the step of:

aligning the cylinder so that said entrance end is higher than said exit end, but said entrance end is not positioned directly above said exit end.

3. A method of cooling rocks or sand as described in claim 1, wherein said chilled gas is introduced into said cylinder through said exit end of said cylinder.

4. A method of cooling rocks or sand as described in claim 1, further comprising the step of:

recirculating said chilled gas by directing said chilled gas out of said cylinder, through air ducting, into contact with a chilled gas or liquid supply, and into said cylinder.

5. A method of cooling rocks or sand as described in claim 4, wherein said chilled gas is directed out of said cylinder through said entrance end, and is directed into said cylinder through said exit end.

6. An apparatus for cooling rocks or sand used in concrete production to a desired aggregate temperature, comprising:

a cylinder with an open entrance end and an open exit end opposite said entrance end, a central axis, an interior and exterior, and an upper portion and bottom portion, wherein the rocks or sand may be introduced into said interior of said cylinder by placing the rocks or sand into said entrance end of said cylinder, prior to combining the rocks or sand with other concrete components to produce concrete, rotation means for rotating said cylinder, and chilled gas means for introducing into said cylinder chilled gas with a temperature lower than ambient air temperature.

7. An apparatus for cooling rocks or sand as described in claim 6, wherein said cylinder is aligned so that said entrance end is higher than said exit end, and said entrance end is not positioned directly above said exit end.

8. An apparatus for cooling rocks or sand as described in claim 6, wherein said cylinder further comprises: a plurality of plates arranged in said interior of said cylinder, each plate having an interior side and an exterior side, each exterior side attached to said cylinder, and each interior side extending toward said axis of said cylinder, so that rotation of said cylinder causes each plate to be rotated from said bottom portion of said cylinder to said upper portion and back to said bottom portion, so that the rocks or sand may be lifted on said plates and dropped into said bottom portion of said cylinder during rotation of said cylinder.

9. An apparatus for cooling rocks or sand as described in claim 8 wherein said plates are flat.

10. An apparatus for cooling rocks or sand as described in claim 8 wherein said plates are curved.

11. An apparatus for cooling rocks or sand as described in claim 6, wherein said chilled gas means further comprises:

chilled liquid supply, and blower means for pushing and directing air into contact with said chilled liquid supply and for further pushing and directing said air into said cylinder.

12. An apparatus for cooling rocks or sand as described in claim 6, wherein said chilled gas means further comprises:

chilled gas supply, and blower means for pushing and directing air into contact with said chilled gas supply and for further pushing and directing said air into said cylinder.

13. An apparatus for cooling rocks or sand as described in claim 6, wherein said chilled gas means further comprises:

cryogen supply, and blower means for pushing and directing air into contact with said cryogen supply and for further pushing and directing said air into said cylinder.

14. An apparatus for cooling rocks or sand as described in claim 11, wherein said chilled liquid supply further comprises a container of 15% solution of glycol and water maintained at less than thirty-two degrees Fahrenheit.

15. A method for cooling rocks or sand as described in claim 1, wherein said chilled gas is generated by forcing ambient temperature gas through a heat exchanger by means of a motor driven blower.

16. A method for cooling rocks or sand as described in claim 15, wherein said heat exchanger comprises a series of refrigerated coils containing chilled liquid.

17. A method for cooling rocks or sand as described in claim 15, wherein said heat exchanger comprises a series of refrigerated coils containing chilled gas.

* * * * *